US006682208B1

(12) United States Patent
Pan

(10) Patent No.: US 6,682,208 B1
(45) Date of Patent: Jan. 27, 2004

(54) LAMP FASTENING STRUCTURE FOR THREE-DIMENSIONAL ORNAMENTAL LIGHTS

(76) Inventor: Wen-Hua Pan, 7F, No. 285, Sec. 4, Chung-Hsiao E. Rd., Taipei City (TW)

( * ) Notice: Subject to any disclaimer, the term of this patent is extended or adjusted under 35 U.S.C. 154(b) by 0 days.

(21) Appl. No.: 10/142,862

(22) Filed: May 13, 2002

(51) Int. Cl.[7] ..... F21V 21/08
(52) U.S. Cl. ..... 362/396; 362/806; 362/252
(58) Field of Search ..... 362/396, 216, 362/806, 800, 249, 252, 391

(56) References Cited

U.S. PATENT DOCUMENTS 4,262,980 A * 4/1981 Heritage ..... 439/164
4,888,671 A * 12/1989 Reimer ..... 362/250
5,727,872 A * 3/1998 Liou ..... 362/252
6,109,765 A * 8/2000 Blanton ..... 362/250

* cited by examiner

*Primary Examiner*—Alan Cariaso
*Assistant Examiner*—Ali Alavi
(74) *Attorney, Agent, or Firm*—Birch, Stewart, Kolasch & Birch, LLP

(57) ABSTRACT

A lamp fastening structure for three-dimensional ornamental lights is deployed in an ornament body for holding a lamp in the ornament body to form a three-dimensional ornamental light. The fastening structure includes a coupling unit fixedly located inside the ornament body and an elastic clip attached to a socket, which couples with the lamp. The elastic clip may be engaged easily and securely with the coupling unit to hold the lamp steadily in the ornament body without wobbling or hitting one another when subject to shaking by external forces, thereby provides brilliant light generation and facilitates installation and storing.

5 Claims, 3 Drawing Sheets

LAMP FASTENING STRUCTURE FOR THREE-DIMENSIONAL ORNAMENTAL LIGHTS

FIELD OF THE INVENTION

The present invention relates to a lamp fastening structure for three-dimensional ornamental lights adopted in various three-dimensional ornamental lights for holding lamps securely without loosing when subject to shaking caused by external forces and providing brilliant lights.

BACKGROUND OF THE INVENTION

Nowadays it is a common practice to decorate sites of festivals and conventions with ornamental articles to foster joyful atmosphere. Ornamental lights are indispensable articles for those events, especially for occasions such as flower lamps in Lantern festival, Christmas lights for Christmas, etc. In addition, in many family parties and gatherings for celebrating special events, ornamental lights are usually being used to augment the amusing and entertaining effect. Many people who care about quality of life also tend to decorate their houses with some sorts of ornamental lights. Hence to use lights for decorating purpose and employ special light brackets to hold and fasten lamps is well accepted and quite popular these days.

However, conventional ornamental lights usually are two-dimensional types with a lamp coupling to a fixed socket to achieve a secured positioning. They mostly offer a two-dimensional and wall decorating effect, but cannot stand by themselves. Comparing with three-dimensional ornamental lights, they are less exciting and do not have lively effect.

While conventional three-dimensional ornamental lights can stand and provide lively effect, they do not have fastening structures to completely anchor lamps in the ornamental lights. Lamps are generally being fastened to the brackets of ornamental lights through fastening bands, and cannot be anchored securely. Installation also is tedious and time-consuming. There are still many problems in practical use, notably:

1. Conventional approaches of fastening lamps to three-dimensional ornamental lights by means of fastening bands often have allowances or gaps formed between the lamps and the ornamental lights. The lamps tend to loosen after being used for a period of time. As a result, the lamps tend to wobble even they are mounted to the three dimensional ornamental lights.
2. In conventional three-dimensional ornamental lights, as lamps are generally being fastened to the brackets of ornamental lights through fastening bands, the fastening bands tend to scatter around and generate untidy environments, and do not have neat and attractive appearances.
3. As lamps are fastened to the brackets of ornamental lights through fastening bands, the lamps could be installed in the ornamental lights in different angles, as a result, the fastening bands could become less effective for holding the lamps securely on the brackets.
4. In conventional three-dimensional ornamental lights, the lamps tend to wobble and result in scattering light phenomenon.
5. In conventional three-dimensional ornamental lights, fastening of lamps is tedious and time-consuming. Lamps and conductive wires tend to hit one another or entangle.

SUMMARY OF THE INVENTION

The primary object of the invention is to resolve aforesaid fastening problems incurred to conventional three-dimensional ornamental lights. The invention of fastening structure for lamps mainly is adopted in various three-dimensional ornamental lights to prevent the lamps from being affected by external shaking forces and to generate brilliant lights.

In order to achieve the foregoing objects, the invention provides a fastening structure for lamps of three-dimensional ornamental lights that includes a coupling unit located in an ornament body and a socket having an elastic clip. The elastic clip may be securely engaged with the coupling unit without wobbling or hitting one another. The structure thus formed is simple and effective.

Another object of the invention is to enable the lamp held in the three-dimensional ornamental light to generate light without scattering.

Yet another object of the invention is to provide a fastening structure that is easy to install and can prevent lamps or conductive wires from hitting one another or entangling.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
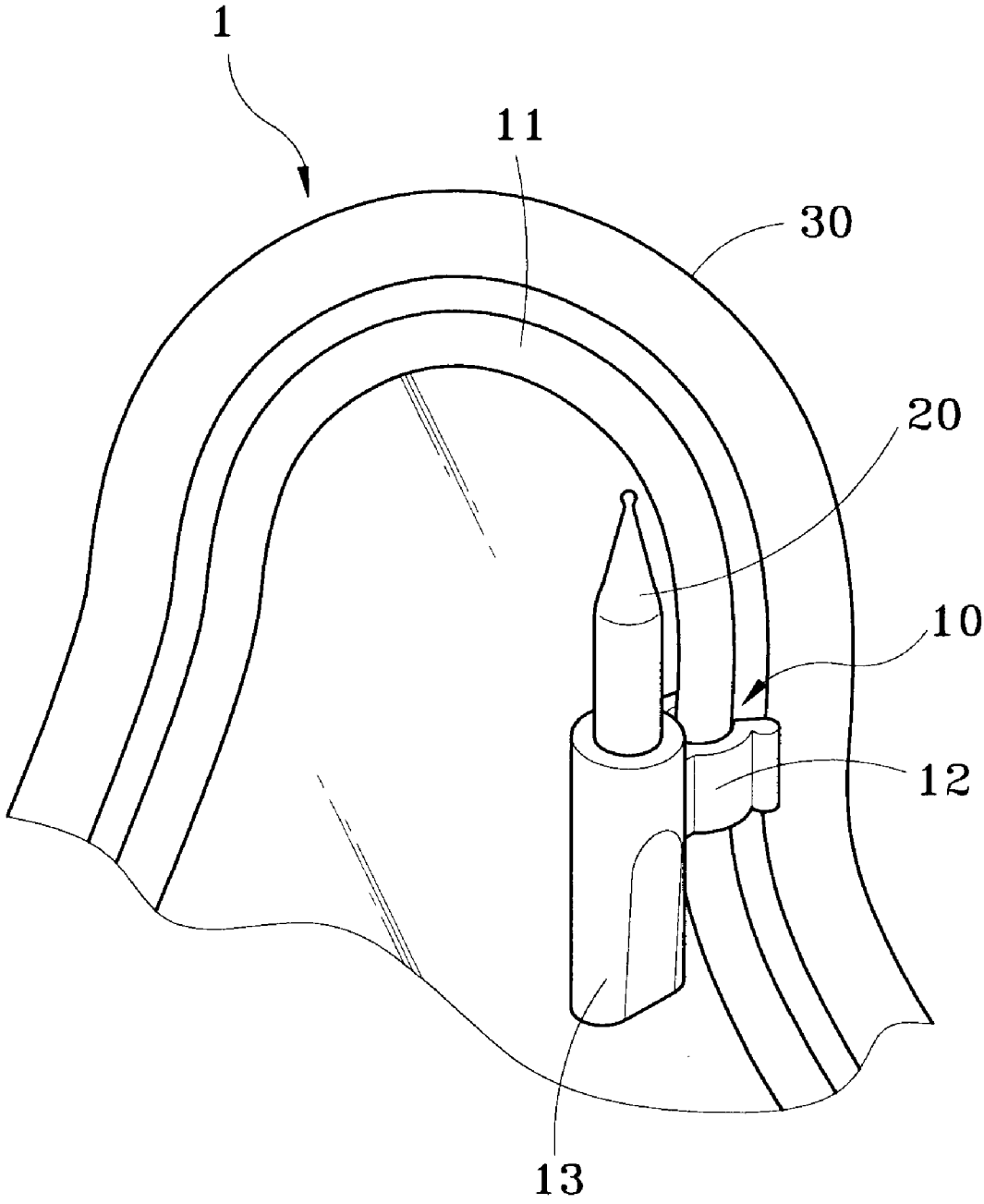
FIG. 1 is a perspective view of the invention.

Referring to FIG. 1, the three-dimensional ornamental light 1 of the invention mainly includes an ornament body 30 coupling with a lamp 20.

Figure 2:
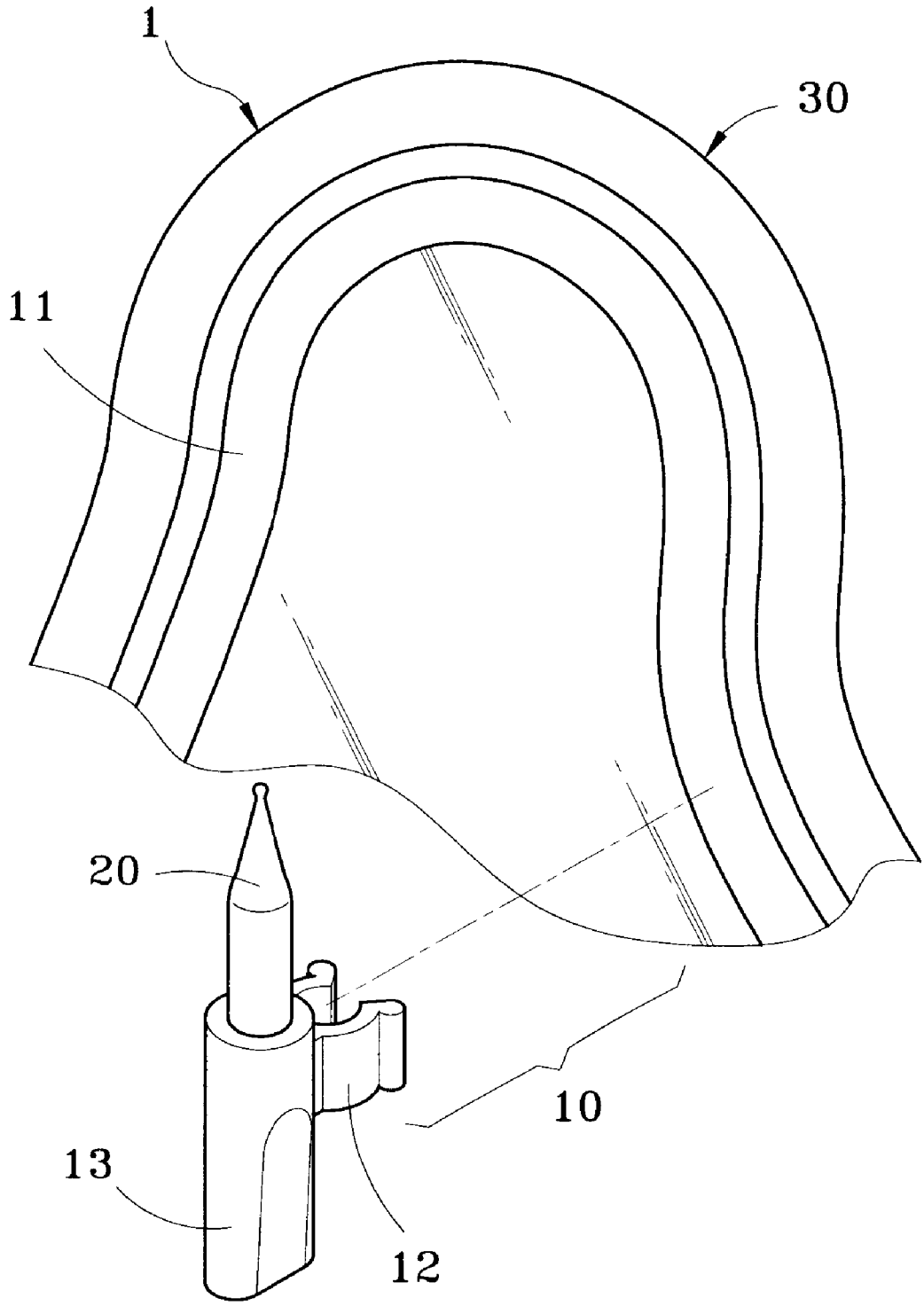
FIG. 2 is an exploded view of the invention.

Referring to FIG. 2, the invention of fastening structure 10 is located in the ornament body 30 and consists of a coupling unit 11 fixedly attached to the ornament body 30 and a socket 13 for holding the lamp 20 has an elastic clip 12 located thereon. The lamp 20 may be a light emitting diode. The elastic clip 12 may be engaged with the coupling unit 11 easily and securely to complete the invention of the fastening structure 10.

The ornament body 30 is made from a hot-melt resistant or high temperature resistant material. The coupling unit 11 is mounted to or integrally formed with the ornament body 30, and is made like a tortuous rod corresponding to the profile of the ornament body 30. The socket 13 also is made from a hot-melt resistant or high temperature resistant material with the elastic clip 12 attached thereon to engage with the coupling unit 11. The lamp 20 held on the socket 13 thus may be anchored securely in the ornament body 30 without hitting one another, and the extended conductive wires 40 (referring to FIG. 3) may also be free from entangling.

After the lamp 20 is mounted to the ornament body 30, the fastening structure 10 provides the lamp 20 a firm support so that the lamp 20 can be held securely without wobbling even the ornament body 30 is shaken by external forces. The lamp 20 has refraction surfaces to generate brilliant light to create steady visual effect.

Figure 3:
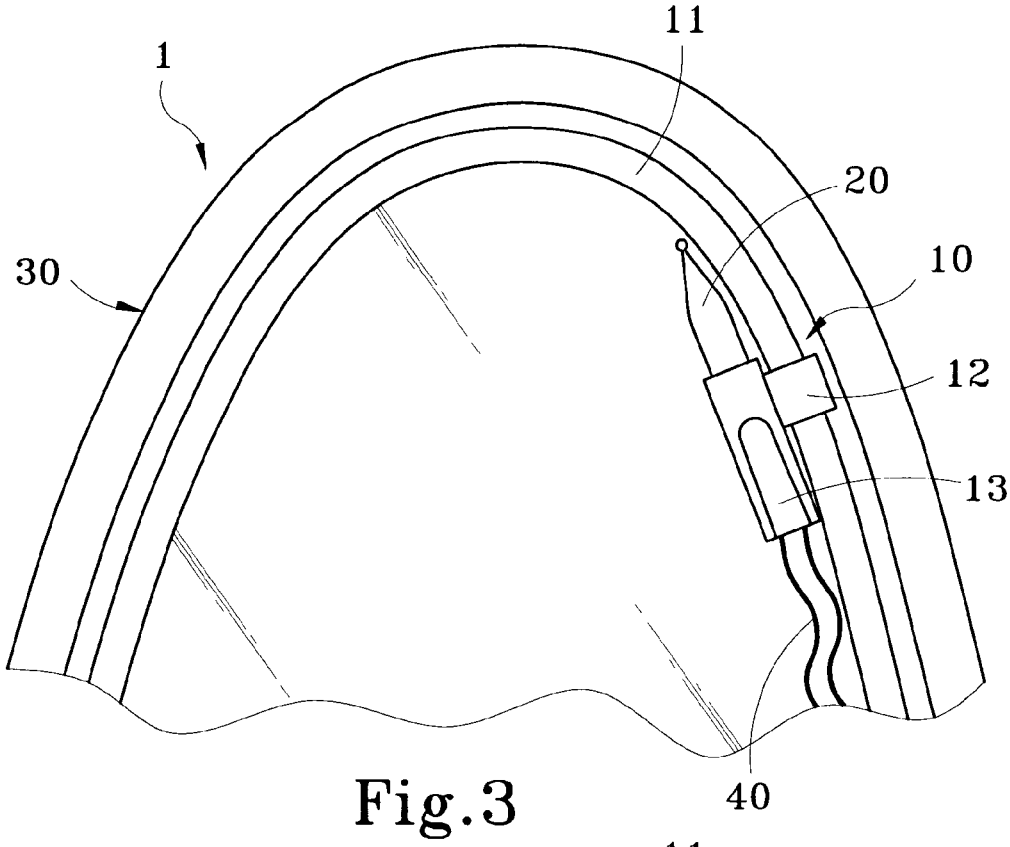
FIG. 3 is a schematic view of the invention in an use condition.
Figure 4:
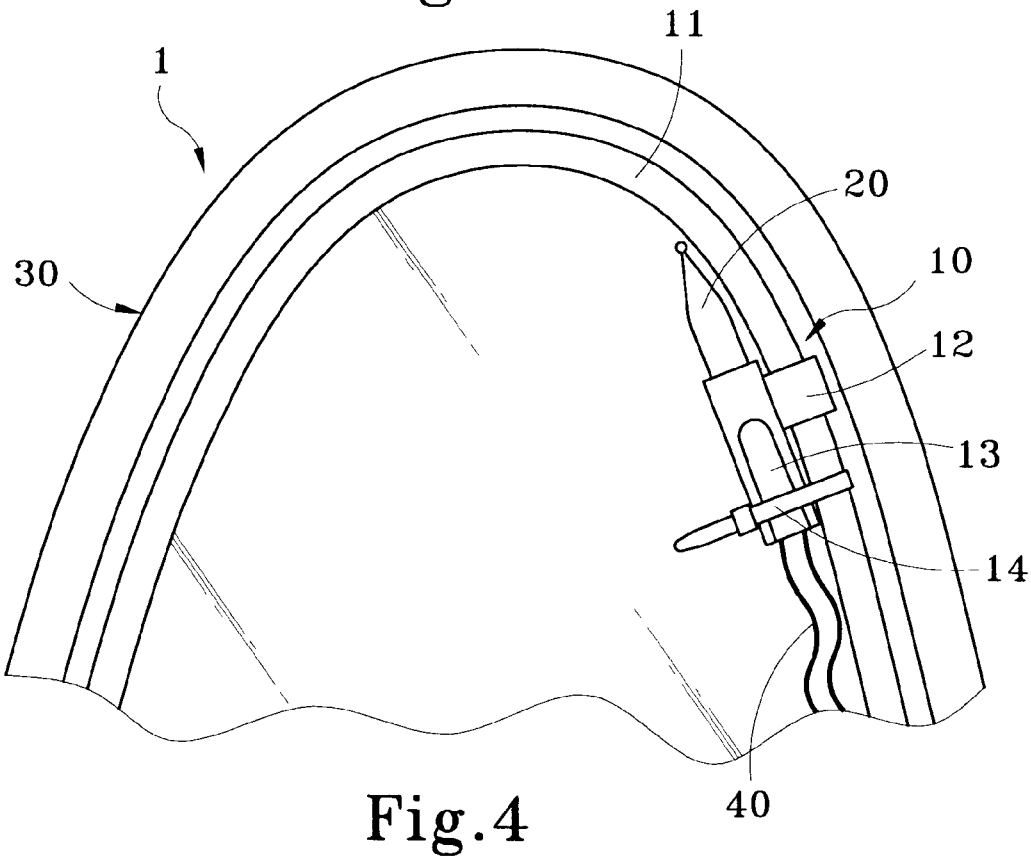
FIG. 4 is a schematic view of the invention in another use condition.

Refer to FIGS. 3 and 4 for the invention in various use conditions. As shown in the drawings, when to deploy the invention in a three-dimensional ornamental light 1, a plurality of sockets 13 with the lamps 20 mounted thereon may be connected in series by conductive wires 40, then the sockets 13 may be mounted in the detached and separated ornamental lights 1. Such an installation technique is known in the art, thus details are omitted here. Only those features related to the invention will be discussed below. After the overall construction is completed, users may couple the elastic clip 12 of the socket 13 to the coupling unit (rod) 13 easily and securely. In order to further enhance the fastening between the elastic clip 12 and the coupling unit 11, an extra fastening unit 14 may be employed to tie the elastic clip 12 and coupling unit 11. This also may prevent the lamp 20 and conductive wires 40 from wobbling or entangling, and prevent emitting light from scattering. As the ornament body 30 is made from a hot-melt resistant or high temperature resistant material, refraction optical paths (not shown in the drawings) of light may be formed steadily. And based on parallax image formation principle that forms images on viewer's left and right eyes, overlapping and versatile cubical images may be generated to create brilliant lights and visual effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lamp fastening structure for three-dimensional ornamental lights, comprising:

an ornament body having a coupling unit fixedly located therein; and a socket for holding a lamp having an elastic clip located thereon;

wherein the elastic clip is engageable with the coupling unit to fasten the socket and the lamp securely in the ornament body to prevent the lamp from wobbling or hitting one another when subject to external shaking forces thereby allows the lamp to generate brilliant light and facilitates installation and storing, further having a fastening unit for fastening the elastic clip and the coupling unit together.

2. The lamp fastening structure for three-dimensional ornamental lights of claim 1, wherein the lamp is a light emitting diode.

3. The lamp fastening structure for three-dimensional ornamental lights of claim 1, wherein the socket is made from a material which is hot-melt resistant or high-temperature resistant.

4. The lamp fastening structure for three-dimensional ornamental lights of claim 1, wherein the coupling unit is a rod formed tortuously corresponding to the profile of the ornament body.

5. The lamp fastening structure for three-dimensional ornamental lights of claim 1, wherein the ornament body is made from a material which is hot-melt resistant or high-temperature resistant.

* * * * *